US008214955B2

(12) United States Patent
Miettinen

(10) Patent No.: US 8,214,955 B2
(45) Date of Patent: Jul. 10, 2012

(54) ENCLOSED BRIDGE

(76) Inventor: Ensio Miettinen, Espoo (FI)

( * ) Notice: Subject to any disclaimer, the term of this patent is extended or adjusted under 35 U.S.C. 154(b) by 92 days.

(21) Appl. No.: 12/679,272

(22) PCT Filed: Sep. 19, 2008

(86) PCT No.: PCT/FI2008/050519

§ 371 (c)(1),
(2), (4) Date: May 19, 2010

(87) PCT Pub. No.: WO2009/037382

PCT Pub. Date: Mar. 26, 2009

(65) Prior Publication Data

US 2010/0299851 A1 Dec. 2, 2010

(30) Foreign Application Priority Data

Sep. 21, 2007 (FI) ..... 20075663

(51) Int. Cl.
*E01D 12/00* (2006.01)

(52) U.S. Cl. ..... 14/13

(58) Field of Classification Search ..... 14/2, 3, 14/77.1, 78

See application file for complete search history.

(56) References Cited

U.S. PATENT DOCUMENTS

| | | | | |
|---|---|---|---|---|
| 11,467 | A * | 8/1854 | Baldwin | 14/74.5 |
| 108,663 | A * | 10/1870 | White | 14/3 |
| 3,688,327 | A * | 9/1972 | Marshall | 14/74.5 |
| 3,738,112 | A * | 6/1973 | Grant et al. | 405/136 |
| 3,859,682 | A * | 1/1975 | Sulkiewicz | 14/3 |
| 4,454,620 | A * | 6/1984 | Barkdull, Jr. | 14/20 |
| 4,704,754 | A * | 11/1987 | Bonasso | 14/20 |
| 5,671,681 | A * | 9/1997 | Senior, III | 104/138.1 |
| 5,680,664 | A * | 10/1997 | Head | 14/4 |
| 6,684,793 | B2 * | 2/2004 | Dutoit | 104/124 |
| 2011/0047722 | A1 * | 3/2011 | Meheen | 14/4 |

FOREIGN PATENT DOCUMENTS

| | | | |
|---|---|---|---|
| DE | 2321264 | A | 11/1973 |
| GB | 1398936 | A | 6/1975 |
| WO | 9006401 | A1 | 6/1990 |
| WO | 2007 147925 | A1 | 12/2007 |

OTHER PUBLICATIONS

Christer Backnert, International Search Report for PCT/FI2008/050519, Dec. 10, 2008.

Tommi Kajander, Finnish Search Report for FI20075663, Aug. 20, 2008.

* cited by examiner

*Primary Examiner* — Raymond W Addie

(74) *Attorney, Agent, or Firm* — Chernoff, Vilhauer, McClung & Stenzel

(57) ABSTRACT

Enclosed bridge, which comprises at least one outer tube (9), which forms the outer surface of the bridge, and at least one inner tube (2) fitted inside the outer tube (9), which forms the interior space of the bridge. A truss structure (1) attached to the structure of the bridge is fitted inside the inner tube (2) and is formed of an element forming at least one node and receiving a tensile loading, which truss structure forms least one chord across the inner tube, from one point on its inner surface to the opposite side of the inner surface.

11 Claims, 2 Drawing Sheets

ENCLOSED BRIDGE

This is a national stage application filed under 35 USC 371 based on International Application No. PCT/FI2008/050519 filed Sep. 19, 2008, and claims priority under 35 USC 119 of Finnish Patent Application No. FI 20075663 filed Sep. 21, 2007.

The present invention relates to an enclosed ultralight bridge for creating a passage for the transportation of materials, for pedestrian and cycle traffic, and for personnel, among other things.

Existing service bridges, tubular bridges, and conveyor bridges comprise a deck with a frame construction and walls, a floor and a roof, which cover the loadbearing structure. Pipes, access decks, cables, and similar are located inside the bridge and require a carrier structure, by means of which they are suspended from the frame structure of the bridge. Thus, the loadbearing structure of the bridge must carry the entire weight and operating elements of the covering protective structures, as well as their carrier structures, so that the carrier structure of the bridge must be strong and heavy. A heavy structure requires in turn support at short intervals on the ground or buildings. Such a heavy structure is slow to build and expensive, because it requires a large amount of materials and work. The cross-section of bridges is usually rectangular. This shape leads to large wind-resisting surfaces and thus to high wind loads. The snow that collects on the roof of the bridge in snowy environments leads to an increased loading. The bridge requires a large surface area on the ground or floor, because the heavy supporting legs are often wide A-frames. Overall, existing bridge structures are very heavy, large, and expensive and their material costs are great.

An attempt to eliminate the drawback of the bridges described above has been made in the international patent application PCT/FI2006/000218. The structure disclosed concerns a shell structure, in which a bridge is formed from two or more tubes inside each other, which are attached to each other. Thanks to the construction, manufacturing and material costs are reduced and construction is faster.

The present invention is intended to create a shell-structure bridge, which is stronger and more secure than previously.

The invention is based on at least one transverse trusswork structure being located inside the shell structure.

More specifically, the bridge according to the invention is characterized by what is stated in the characterizing portion of the independent Claim.

Various embodiments of the invention are described in greater detail in the dependent Claims.

Considerable advantages are gained with the aid of the invention.

The ultimate strength of a bridge formed as a shell and/or cellular/shell structure is often determined by its buckling strength, and can thus be less than the structural stiffness and strength of the bridge would otherwise be. The thicknesses of material in the shell structure can, in principle be very small, but there is then the danger that the structure will collapse due to a loading peak, or a loading coming from an unexpected direction. The stiffness of the structure also weakens as the span of the supports increases, and it can happen that even though the strength of the structure might be sufficient, its insufficient stiffness and the consequent deformations will require, for example, an increase in the thickness of the material. As the amount of material required by a shell structure made from thin sheet increases rapidly as the material thickness increases, this will also lead to a rapid increase in costs and the weight of the structure. In the solution according to the invention, the structure is supported from inside by a truss structure, by means of which the stiffness and buckling strength are advantageously increased relative to the weight and material costs, compared to increasing the thickness of the material or supporting the structure in some other way. It has been possible to demonstrate computationally that the stiffness and buckling strength of the bridge increase significantly with the aid of the truss structure.

As is known, a truss structure is easy to manufacture and can be attached in many different ways to the shell and/or cellular/casing structure of a bridge.

In the following, the invention is described in greater detail with reference to the accompanying drawings.

Figure 1:
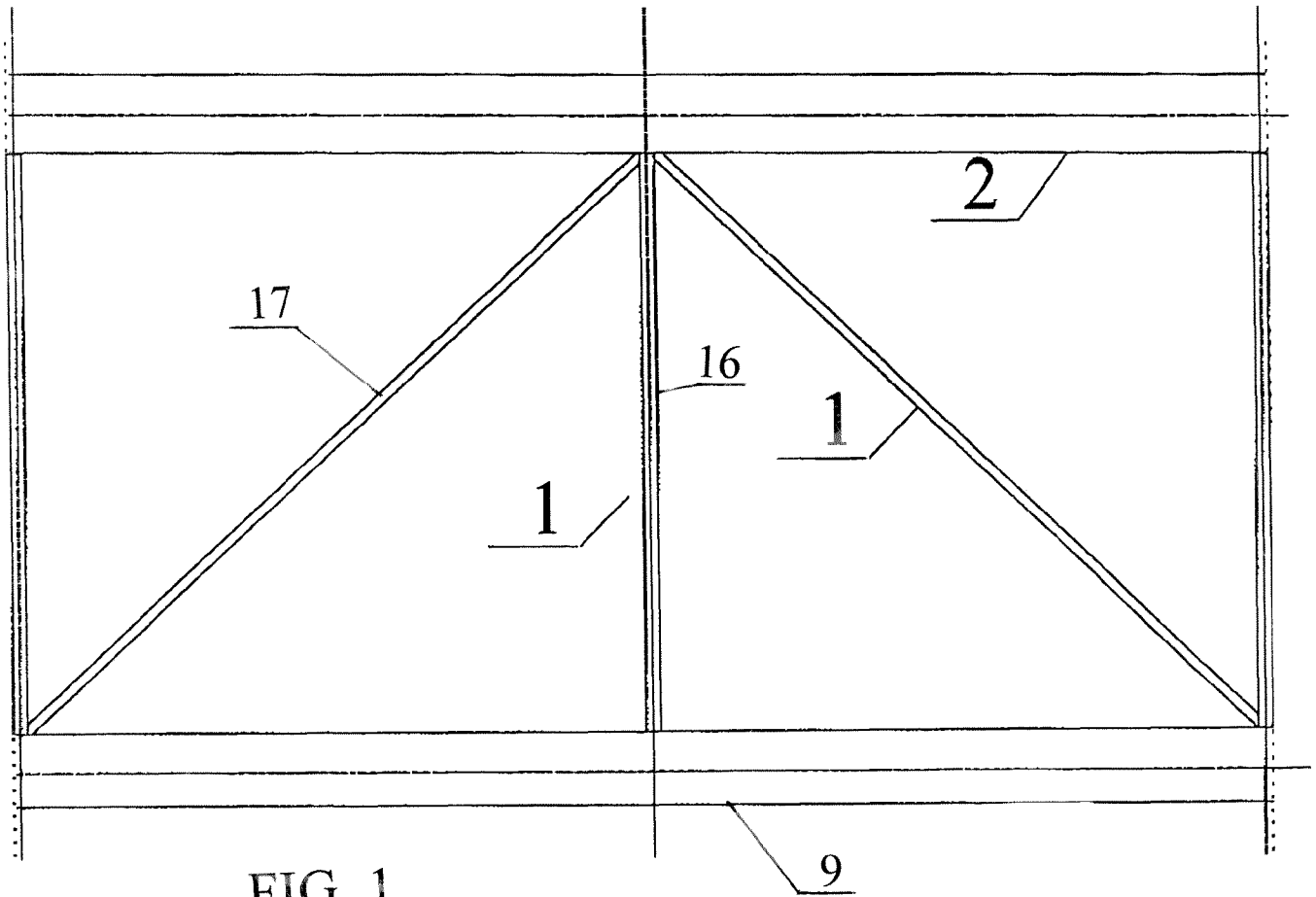
FIG. 1 shows a schematic longitudinal section of a shell-structure bridge.

The structure described in the following is intended for use in connection with the enclosed bridge disclosed in international application PCT/FI 2006/000218. Thus, the construction of the bridge itself and alternative structures are not described here in greater detail, instead the relevant portions of the text of the aforementioned application are incorporated in the present description.

An enclosed bridge according to the invention consists of an inner tube 2 delimiting the internal part of the bridge and an outer tube 9 forming the outer shell. The outer tube 9 and the inner tube 2 are attached to each other, for example, by welding of bolting, in order to create a two-layer shell structure. The shape of the outer and inner tubes 2, 9 can be advantageously the oval shown in the figures, circular, or some other desired shape. In the space remaining between the outer tube 9 and the inner tube, conduits 10 are situated, which can be used as spaces for electrical cables, communications cables, and similar, or as transportation spaces for water, steam, or other materials. These conduits 10 are attached to the outer surfaces of the inner tube 2 and correspondingly to the inner surfaces of the outer tube 9, and thus form a support tying the outer and inner tubes 9, 2 into a unified shell, cellular, or casing structure. In addition, the conduits are attached to each other, with the aid of, for example, a welded seam 4, to further increase the stiffness of the structure. In addition to the conduits 10, the outer and inner tubes can be secured to each other by means of additional supports, for example, casing structures or supporting steel 6 forming a dividing plane in the bridge. In addition, the structure is supported by the intermediate bulkheads of the bridge and the end bulkhead 8 of the manufacturing module. In this example, both a walkway 11 and a conveyor belt 12 are located in the interior of the bridge. The interior space can be used freely for various structures and can be pressurized, or filled with steam or even an inert gas, if desired.

In this example, the bridge is formed of two modules, which are linked by a dividing place 13 running horizontally, which is reinforced by a casing structure or supporting steel 6. The bridge can consist of (for example, for transport) two or more modules, which are attached to each other at the installation site by a dividing plane 13. The dividing plane 13 can be structurally a casing, a cell, a stiffener, or some other similar structure. The joint between the modules can be made by welding or bolting them together, or in some other way. By forming the bridge from modules, it can be made as far as possible by prefabrication at a factory, so that manufacture can be made more efficient and automated, and the actual assembly of the bridge at the installation site will be rapid. The structure 6 formed by the dividing plane 13 carried vertical and horizontal loads, withstands moment stresses, and for its part prevents the bridge from buckling. In this example, one unit of the bridge consists of two modules, i.e. an upper former 14 and a lower former 15. The outer tube 9 part and the inner tube 2 part of each former 14, 15 are attached to each other by means of bulkheads 8, which can be located at the end of the prefabricated module and/or at suitable intervals along the length of the module. For their part, the bulkheads 8 tie the outer tube 9 and the inner tube 2 to each other and stiffen the structure. The bulkheads can be curved, extending towards the inner part of the bridge, thus leaving a passage where they are located. A bulkhead construction can also be used to close the cross-section of the bridge at desired points, by making the bulkhead construction a wall or door at these points. In addition, end bulkheads 8 can be used to join the units of the bridge together. The joint can be made, for example, by welding, bolting, riveting, or in some other known manner. The upper and lower former 14, 15 can consist of one or more tubes, cases, or cells, which are joined together by welding, or bolting, or in some other manner. The structure will carry vertical and horizontal loads and withstand moment strains. A module formed in this way is an independently stiff structure and thus is easy to transport and handle during installation. In factory conditions, it is also easy to make a moisture barrier or thermal insulation in the modules, which is located in this case in the outer surface of the outer tube 9 of the module. The thermal and moisture insulation can be made by casting, spraying, rolling, wrapping, or attaching in some other suitable manner, for example, by gluing.

A truss structure 1 is located inside the bridge, in order to increase its stiffness and buckling strength. In the case of the example, the truss structure 1 is located on the vertical axis of the bridge and is formed of vertical supports 16 and slanting supports 17. The slanting supports run from the upper ends to the lower ends of the vertical supports 16 so that the truss structure thus forms a triangular truss. A truss of this kind is strong and light. In addition to a vertical truss, it is possible to use a horizontal truss or a slanted truss while a support truss can be drawn to the side from the centre or horizontal line.

Figure 2:
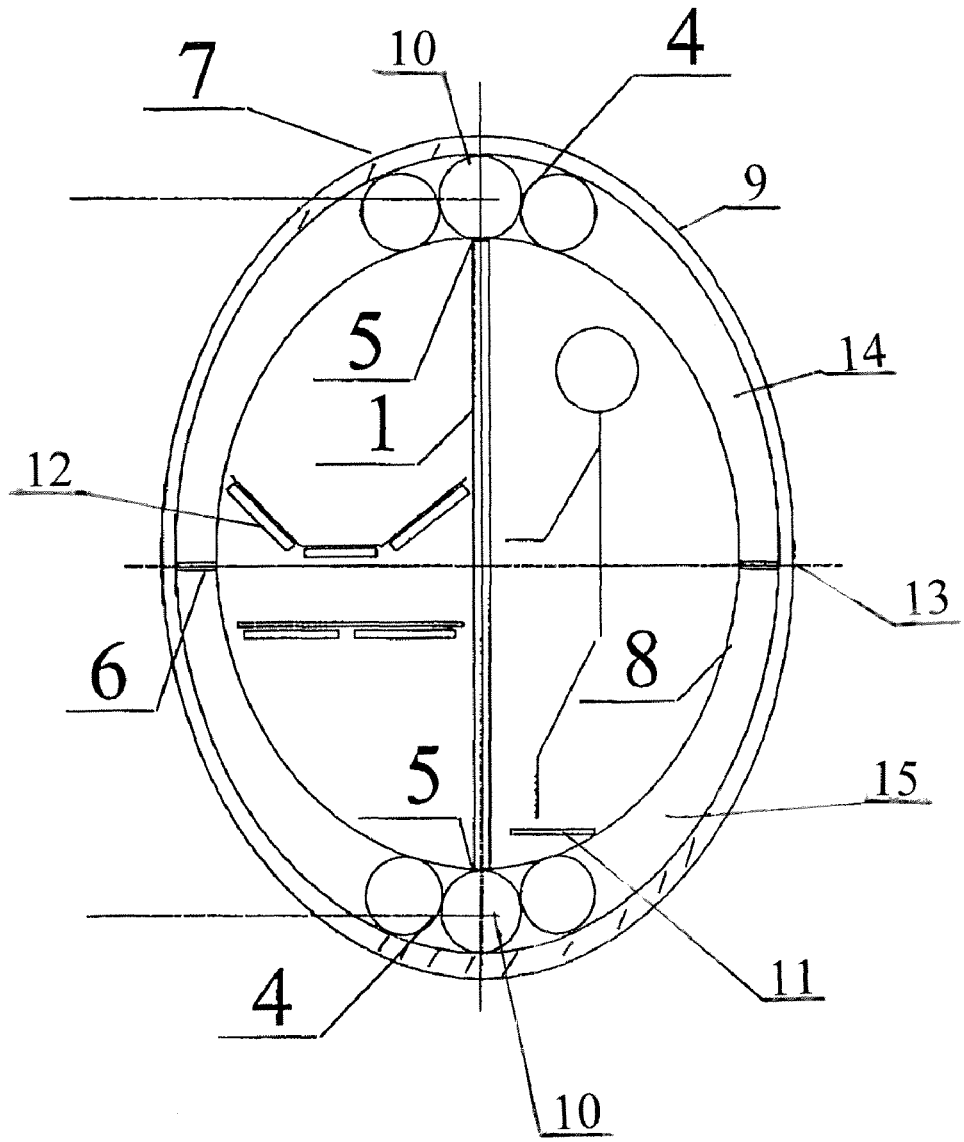
FIG. 2 shows a transverse section of the bridge of FIG. 1.

The vertical truss structure 1 is attached by welding, bolting, or some other similar manner to the upper and lower former 14, 15, at the location 5 in the inner tube 2, or to a corresponding structure in the lower former, which can be a tube, case, cell, a stiffener made in some other shape, or some other similar support structure. In the examples of FIG. 1 and FIG. 2, the vertical supports 16 and ends of the slanting supports of the truss are located in the end and intermediate bulkheads, so that they provide strong support. The vertical truss structure stiffens the enclosed bridge in the vertical direction. The truss structure for its part prevents the bridge from buckling. The vertical truss structure divides the bridge into different passages and the truss structure can be used, for instance as a frame structure for a isolating partition wall, or as a support structure for device installations while, in addition, there can be several vertical truss structures.

The vertical truss structure is attached correspondingly by welding or bolting or in some other similar manner to the former at the side, in which the attachment point can be a tube, casing, cell, a stiffener made in some other shape, or some other similar support structure. The horizontal truss structure stiffens the enclosed bridge laterally. The horizontal truss structure can be at different heights and at the same time can support isolating levels, walkways, or equipment shelves, of which there can be several.

The horizontal truss structure, for its part, prevents the bridge from buckling and significantly increases the structural stiffness relative to the weight of the material used. Thus the bridge has a good loading ratio.

As stated above, the truss structure or structures can be horizontal, vertical, or set at a slant to these planes. A truss, or several trusses can also be located to the side of the centre line of the structure, in which case it will form a chord in the cross-section of the interior of the bridge, which runs from one point on the surface of the inner tube to a point on the opposite surface. In addition to the simple triangular structure described in the example, the truss can be made as a multiple-triangle structure, or it can consist of polygons, or even curves. The truss is formed of bars attached to each other and receiving tensile and compressive loads, which bars can have different profiles. It can also be envisaged, that the truss is formed of cables or similar, which are attached to the bridge, for instance, by loops and then pretensioned. However, a cable-like element will only accept tensile loading, which must be taken into account when assessing the strains acting on the structure and when designing the structure. Bars, cables, or similar are attached to each other at their ends, forming nodes, or they can be a single unified piece, in which the nodes are formed by bending the element to be loaded.

The cross-section of the bridge can vary in many ways, the truss structure being adapted to the bridge cross-section being used at the time. The bridge can consist of several bridge unit attached to each other at their ends. The joints between the ends of the tubes, cells, cases, bars, and similar structures are made in a manner suiting the bridge application being used, in other words by welding, flanged joints, bolting, threaded pieces, adapter, extension, or junction pieces. The joint elements can be integrated in the end bulkhead.

The invention claimed is:

1. Enclosed bridge, which comprises at least one outer tube, which forms the outer surface of the bridge, and at least one inner tube fitted inside the outer tube, which forms the internal space of the bridge, as well as at least one truss structure fitted inside the inner tube and attached to the structure of the bridge, which is formed of an element forming at least one node, which truss structure forms least one chord across the inner tube, from one point on its inner surface to the opposite side of the inner surface, wherein the truss structure is a rigid truss structure assembled from bar-like elements receiving tensile and compressive loadings.

2. Bridge according to claim 1, wherein the truss structure is formed of elements receiving only a tensile loading.

3. Bridge according to claim 1, wherein the truss structure is attached to the inner tube.

4. Bridge according to claim 1, comprising at least one bulkhead.

5. Bridge according to claim 1, wherein the bridge is formed from at least two modules, which are separated from each other by a dividing plane, which can be used to assemble the module structure to form a bridge unit.

6. Bridge according to claim 1, wherein the bridge comprises a plurality of bridge units and the bridge units comprise end bulkheads, in which there are elements for jointing the bridge units to each other.

7. Bridge according to claim 1, wherein at least one truss structure is vertical.

8. Bridge according to claim 1, wherein at least one truss structure is horizontal.

9. Bridge according to claim 1, wherein at least one truss structure forms the frame of a wall or floor dividing the interior of the bridge.

10. Bridge according to claim 6, wherein each bridge unit is formed from at least two modules, which are separated from each other by a dividing plane.

11. Bridge according to claim 1, wherein the truss structure is a triangular truss structure comprising vertical bar-like elements and slanting bar-like elements.

* * * * *